US006116014A

United States Patent [19]

Dalla Betta et al.

[11] Patent Number: 6,116,014

[45] Date of Patent: Sep. 12, 2000

[54] SUPPORT STRUCTURE FOR A CATALYST IN A COMBUSTION REACTION CHAMBER

[75] Inventors: Ralph A. Dalla Betta, Mountain View; James C. Schlatter, Palo Alto, both of Calif.; Martin Bernard Cutrone, Niskayuna; Kenneth Winston Beebe, Galway, both of N.Y.

[73] Assignees: Catalytica, Inc., Mountain View, Calif.; Tanaka Kikinzoku K.K., Tokyo, Japan; General Electric Company, Schenectady, N.Y.

[21] Appl. No.: 08/462,639

[22] Filed: Jun. 5, 1995

[51] Int. Cl.[7] ..... F02C 3/00; F23R 3/40

[52] U.S. Cl. ..... 60/39.06; 60/723; 60/39.32; 431/7; 502/527

[58] Field of Search ..... 60/39.06, 39.822, 60/39.31, 39.32, 723; 431/7, 170, 328; 502/527

[56] References Cited

U.S. PATENT DOCUMENTS

| | | | |
|---|---|---|---|
| 2,285,944 | 6/1942 | Rigby | 431/328 |
| 3,135,703 | 6/1964 | Sill | 60/39.462 |
| 3,903,693 | 9/1975 | Fox | 60/39.32 |
| 3,928,961 | 12/1975 | Pfefferle | 60/723 |
| 3,940,923 | 3/1976 | Pfefferle | 431/7 |
| 3,993,600 | 11/1976 | Hunter | 502/527 |
| 4,134,733 | 1/1979 | Volker et al. | 502/527 |
| 4,285,193 | 8/1981 | Shaw et al. | 60/723 |
| 4,301,035 | 11/1981 | Risse | 431/7 |
| 4,397,356 | 8/1983 | Retallick | 60/723 |
| 4,864,811 | 9/1989 | Pfefferle | 60/39.06 |
| 4,870,824 | 10/1989 | Young et al. | 60/723 |
| 5,183,401 | 2/1993 | Dalla Betta et al. | 431/7 |
| 5,232,357 | 8/1993 | Dalla Betta et al. | 431/7 |
| 5,248,251 | 9/1993 | Dalla Betta et al. | 431/7 |
| 5,250,489 | 10/1993 | Dalla Betta et al. | 502/262 |
| 5,258,349 | 11/1993 | Dalla Betta et al. | 502/330 |
| 5,259,754 | 11/1993 | Dalla Betta et al. | 431/7 |
| 5,394,300 | 2/1995 | Feeley et al. | 502/252 |
| 5,461,864 | 10/1995 | Betta et al. | 60/723 |
| 5,551,239 | 9/1996 | Feeley et al. | 60/723 |

FOREIGN PATENT DOCUMENTS

| | | | |
|---|---|---|---|
| 59-225211 | 12/1984 | Japan | 60/723 |

*Primary Examiner*—Timothy Thorpe
*Assistant Examiner*—Ted Kim
*Attorney, Agent, or Firm*—Al A. Jecminek

[57] ABSTRACT

A support structure for securing a catalyst structure comprising a multiplicity of longitudinally disposed channels for passage of a flowing gas mixture within a reactor, said support structure being comprised of a monolithic open celled or honeycomb-like structure formed by thin strips or ribs of high temperature resistant metal or ceramic which abuts against one end of the catalyst structure, and extends in a direction perpendicular to the longitudinal axis of the catalyst structure to essentially cover an end face (at either the inlet end or outlet end or both) of the catalyst structure with the support structure being secured on its periphery to the reactor wall. The strips or ribs making up the support structure are bonded together to form a unitary structure having cellular openings at least as large as the catalyst structure channel openings. The cellular openings in the support structure are also positioned to be in fluid communication with the channels of the catalyst structure thus affording essentially unaltered gas flow from the catalyst structure through the support structure.

29 Claims, 10 Drawing Sheets

SUPPORT STRUCTURE FOR A CATALYST IN A COMBUSTION REACTION CHAMBER

FIELD OF THE INVENTION

This invention relates to improved support structures for securing monolithic catalyst structures used in high temperature reactions, such as catalytic combustion, within a reaction chamber or reactor. In addition, the present invention is directed to a method for using the improved support structure in high temperature catalytic processes, like catalytic combustion for gas turbine power plants.

BACKGROUND OF THE INVENTION

A variety of high temperature processes are known which employ monolithic catalyst structures to promote the desired reactions, for example partial oxidation of hydrocarbons, complete oxidation of hydrocarbons for emissions control, catalytic mufflers in automotive emissions control and catalytic combustion of fuels for further use in gas turbines, furnaces and the like. Typical of such catalytic systems are the catalysts used in thermal combustion units for gas turbines to provide low emissions and high combustion efficiency. To achieve high turbine efficiency, a high gas temperature is required. This, of course, places a high thermal stress on the catalyst monolith employed, which is typically a unitary or bonded metallic or ceramic structure made up of a multitude of longitudinally disposed channels for passage of the combustion gas mixture, with at least a portion of the channels being coated on their internal surfaces with a combustion catalyst.

In addition to high thermal stress, the high gas flow rates characteristic of combustion units in gas turbines place a significant axial load or force on the catalyst structure pushing in the direction of the gas flow due to the resistance to gas flow, i.e., friction, in the longitudinally disposed channels of the catalyst structure. For example, if a multistage monolithic catalyst structure such as that described in U.S. Pat. No. 5,183,401 to Dalla Betta et al. is employed as a 20 inch diameter catalyst in a catalytic combustion reactor where air/fuel mixture flow rate is about 50 lbs/second at a pressure drop through the catalyst of 4 psi, the total axial load on the catalyst would be about 1,260 lbs.

The combination of exposure to both high temperatures, e.g., temperatures approaching and even exceeding 1,000° C., where metallic monoliths begin to lose strength, and the aforesaid large axial loads (from high gas flow rates) can cause significant movement or deformation of the catalyst support. In fact, in cases where a corrugated metal foil catalyst monolith is used in which the corrugated foil is rolled together in a non-nesting fashion to form a cylindrical, spiral structure in which the foil layers are not bonded together, the combined high temperature and large axial load from high gas flow can cause the whole structure to telescope in the direction of gas flow, particularly when the axial force exceeds the foil-to-foil sliding resistance in the wound structure. Hence, there is a need to provide a support for the catalyst structure to secure it from movement and/or deformation along its axis in direction of gas flow by means of a support structure which will provide the necessary support at high temperatures without interfering with the efficiency and effectiveness of catalytic combustion as a source of motive force for a gas turbine.

In co-pending U.S. patent application Ser. No. 08/165,966 to Dalla Betta et al. filed on Dec. 10, 1993 (Attorney Docket No. P-1065), the use of internally cooled support struts or bars at the outlet to the catalyst structure is described as a means to support the catalyst. This approach has the advantage that the support struts are cooled by air or other heat transfer medium and for this reason the support struts can have high strength against axial loads even at very high temperatures. However, this approach has the disadvantage that the support struts require a source of cooling air and this results in a more complicated combustor system design or requires the use of high pressure air that may not be available in the gas turbine machine. An additional disadvantage is that the air cooled struts are rather widely spaced over the face of the catalyst. This results in high local contact forces or stresses. In certain portions of the catalyst design, these contact forces can exceed the yield strength of the thin catalyst foil resulting in deformation of the foil. This would dearly not be a desirable result and would detract from usage of the air-cooled support struts in high axial load applications.

One possible solution to the foil deformation problem is to provide more cooled support bars so that the contact stress at the outlet face of the catalyst is reduced. However, since the air cooled support bars are rather thick, the use of large numbers of these at the catalyst outlet will increase the blockage to gas flow and increase the overall pressure drop in the combustor system, which is undesirable. Also, the spacing of the air cooled bars would have to be very close to decrease the contact stress with the catalyst foil.

Another possible approach is to use an uncooled metal support. This would allow the support bars to be much thinner in cross section and reduce the total cross-sectional area and the resulting pressure drop. However, this also has a conceptual problem in that the conventional thinking is that at the high operating temperatures of these systems, most metals have greatly reduced strength and would not be able to support the axial load without using a very thick material resulting in high blockage of the gas flow.

SUMMARY OF INVENTION

Surprisingly, an uncooled support structure constructed out of high temperature resistant metal or ceramic has now been found which can serve as a superior means for securing a monolithic catalyst structure, comprising a multiplicity of longitudinally disposed channels for passage of a flowing gas mixture, within a reactor designed for high temperature reactions and high gas flow rates or through puts, without creating an undue pressure drop or otherwise interfering with the catalytic reaction. This uniquely effective support structure comprises a monolithic honeycomb or open cellular support structure having cellular openings at least as large as the channels in the catalyst structure, said cellular openings being in fluid communication with the catalyst structure channels and being formed by thin strips or ribs of high temperature resistant metal or ceramic that are bonded together to afford a unitary structure which abuts against and extends over the entire outlet face of the catalyst structure, with its peripheral edge being secured to the reactor wall in a manner so that any axial force placed on the open cellular support structure will be transferred to the reactor wall.

Despite its open celled appearance, the monolithic honeycomb or open cellular support structure of the invention possesses sufficient strength when secured to the reactor wall to withstand the axial load or force placed on it by the catalyst structure operating at high temperatures and at high gas flow rates, such that any axial movement or deformation of the catalyst structure is minimized. Further, the inherent strength of the open-celled structure allows for the use of rather thin strips or ribs of metal or ceramic in the structural framework and this, coupled with the use of open cells which are at least as large as the catalytic reactor channel openings, enables the support structure of the invention to be used advantageously in high gas flow rate applications where pressure drop across the support structure is to be avoided, e.g., catalytic combustion of a fuel/air mixture for subsequent use in a gas turbine. Finally, the honeycomb-like or open-celled nature of the support structure of the invention provides a multiplicity of support strips or ribs which abut against the catalyst structure over its entire end face or cross-section, and therefore, the axial load of the catalyst structure is spread more uniformly over the entire monolithic support structure and localized deformations in the catalyst structure are avoided.

While the monolithic open-celled support structures of the invention are most desirably placed at the outlet end or side of the catalyst structure to secure the catalyst structure against axial movement in the direction of gas flow through the catalyst structure, their very low resistance to gas flow through the support structure also makes them attractive candidates for supporting the inlet side of the catalyst structure against any backward movement in the event of sudden gas flow upsets. Further, in cases where a multi-stage catalyst system is used such as that disclosed in the aforesaid U.S. Pat. No. 5,183,401 to Dalla Betta et al., the support structure of the invention can be placed at the outlet end of one or more of the catalyst stages and thus function as an interstage support relieving axial force on subsequent catalyst stages.

Accordingly, one aspect the invention is directed to a support structure for securing within a reaction chamber a catalyst structure made up of a multiplicity of longitudinally disposed channels with inlet and outlet ends for passage of a flowing gas mixture, said support structure comprising a monolithic open cellular structure wherein the walls of the cells are formed by strips of a high temperature resistant metal or ceramic material to afford cellular openings which are at least as large as the openings formed by the catalyst structure channels at their inlet and outlet ends, said monolithic open cellular structure being:

(a) placed at the outlet end of catalyst structure, or at the inlet end of the catalyst structure or at both the inlet end and the outlet end of the catalyst structure;

(b) positioned and configured to abut against one end of the catalyst structure and extend in a direction perpendicular to the longitudinal axis of the catalyst structure to essentially cover the end face of the catalyst structure, with the cellular openings of the monolithic open cellular structure being in fluid communication with the channels of the catalyst structure; and (c) secured on its periphery to the reaction chamber wall such that the axial load which is placed on the monolithic open cellular structure is transferred to the reaction chamber wall, thereby limiting axial movement of said catalyst structure parallel to the longitudinal axis of said catalyst structure.

Another aspect of the invention is focused on an improved process for catalytic combustion or partial combustion of a fuel which is particularly applicable to gas turbine applications, wherein the monolithic open cellular support structure of the invention is utilized to secure the combustion catalyst structure within the combustor or reaction chamber. This process comprises the steps of:

(a) forming a mixture of the fuel with an oxygen-containing gas; and (b) passing the oxygen-containing gas and fuel mixture as a flowing gas stream through a monolithic catalyst structure positioned in a reaction chamber, said catalyst structure made up of a multiplicity of longitudinally disposed channels for passage of said flowing gas stream, said catalyst structure being stabilized in said reaction chamber by means of a monolithic open cellular structure in which the walls of the cells are formed by strips of a high temperature resistant metal or ceramic material to afford cellular openings which are at least as large as the openings formed by the catalyst structure channels at their inlet and outlet ends, said monolithic open cellular structure being:

(i) placed at the outlet end of catalyst structure, or at the inlet end of the catalyst structure or at both the inlet end and the outlet end of the catalyst structure;

(ii) positioned and configured to abut against one end of the catalyst structure and extend in a direction perpendicular to the longitudinal axis of the catalyst structure to essentially cover the end face of the catalyst structure, with the cellular openings of the monolithic open cellular structure being in fluid communication with the channels of the catalyst structure; and (iii) secured on its periphery to the reaction chamber wall thereby limiting the axial movement of said catalyst structure parallel to the longitudinal axis of said catalyst structure.

Other aspects of the invention include a method for securing the monolithic catalyst structure in a reactor or reaction chamber using the monolithic open cellular structure of the invention and support structures according to the invention used as interstage supports for multistage catalytic processes employing monolithic catalysts.

DETAILED DESCRIPTION OF THE INVENTION

This invention comprises an uncooled support structure for securing the position of a monolithic catalyst structure within a reaction chamber or reactor where the catalyst structure is subject to high temperatures and large axial loads due to high gas flow rates through the catalyst. In addition, this invention is directed to a method using this support in a catalytic combustion process. More particularly, this invention is directed to a support structure which limits the axial movement of a relatively flexible monolithic catalyst structure within a combustion reactor. In addition to limiting the axial movement of the catalyst structure, the support structure increases the strength of the catalyst against the force imposed by the gas flow through the catalyst.

Figure 1:
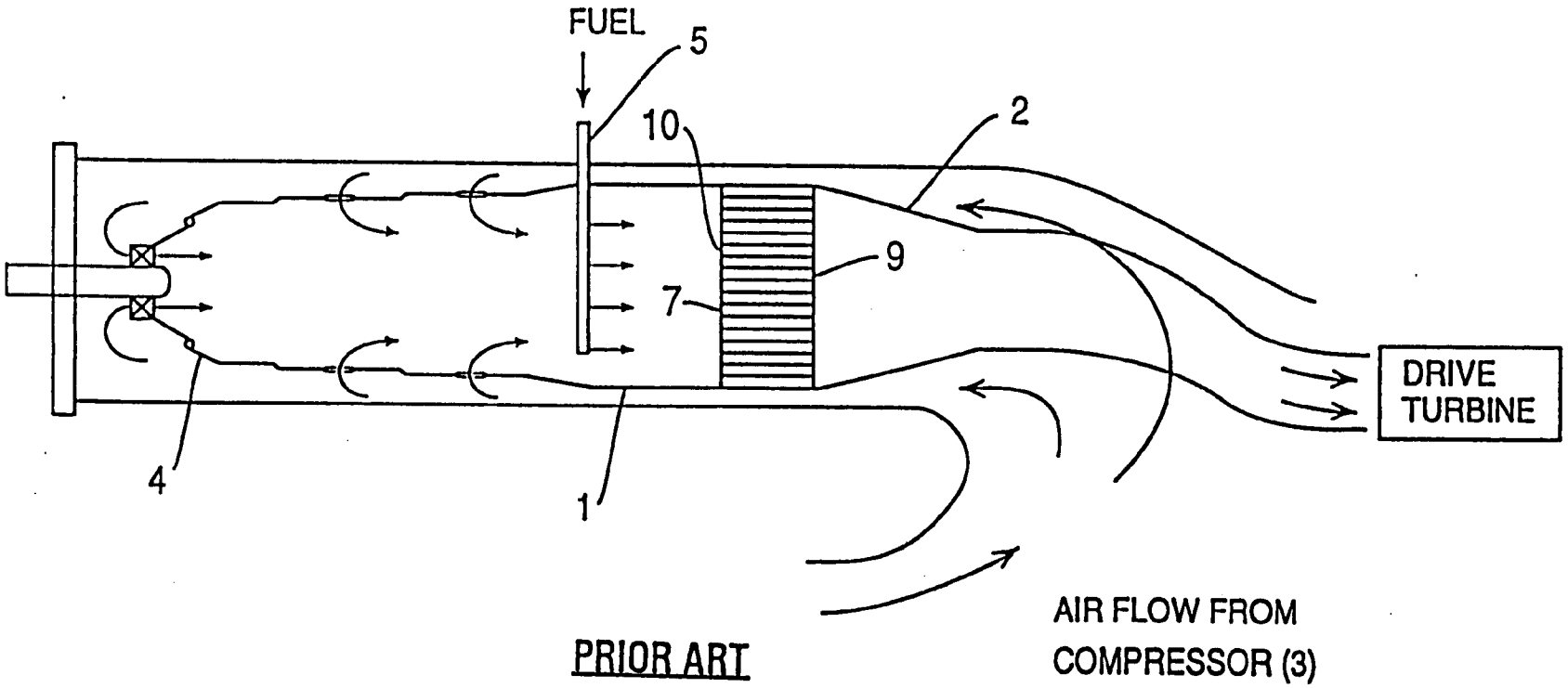
PRIOR ART FIG. 1
FIG. 1 is a side view of a catalytic combustion reactor in a gas turbine combustor.

A typical catalytic combustion reactor is shown in FIG. 1. As shown in this figure, a catalyst structure (10) is positioned in a combustion reactor (1) downstream of a preburner (4) and perpendicular to the flow of an oxygen-containing gas, typically an air and fuel mixture, the fuel being introduced to the monolithic catalyst structure via fuel injector (5). The catalyst structure is positioned in this manner to obtain a uniform flow of air/fuel mixture through the catalyst, and to allow the mixture to pass through passageways which extend longitudinally through the catalyst structure. In order to maintain the catalyst structure in a stable position in the combustion reactor, it is necessary to employ some type of support means or structure to secure the catalyst structure to the combustion reactor, including, as one possibility, a support structure which abuts the outlet side (9) of the catalyst structure. As used herein, the "outlet side" (9) of the catalyst structure is the side where the partially or completely combusted air/fuel mixture exits the catalyst structure. Therefore, the "inlet side" of the catalyst structure is the side where the uncombusted air/fuel mixture is initially introduced to the catalyst structure.

Figure 2A:
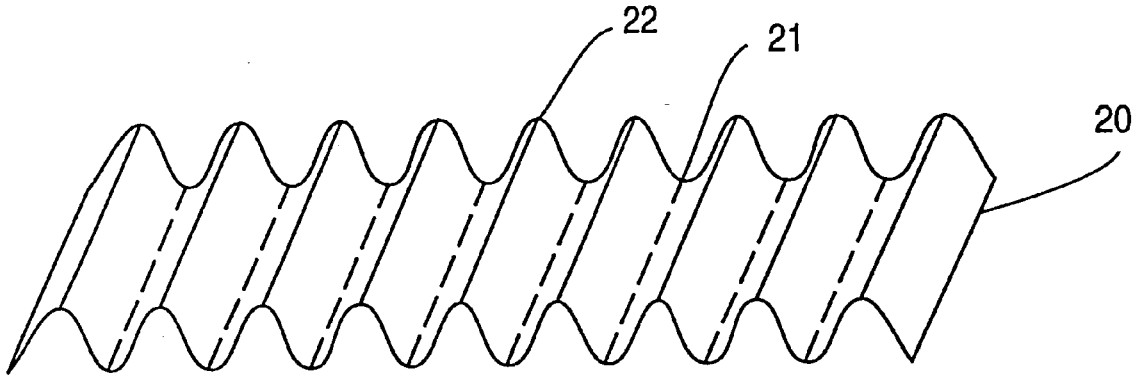
FIG. 2A and 2B depict the fabrication of a monolithic catalyst structure which may be usefully secured within a reactor using the monolithic support structure of the invention.
Figure 2B:
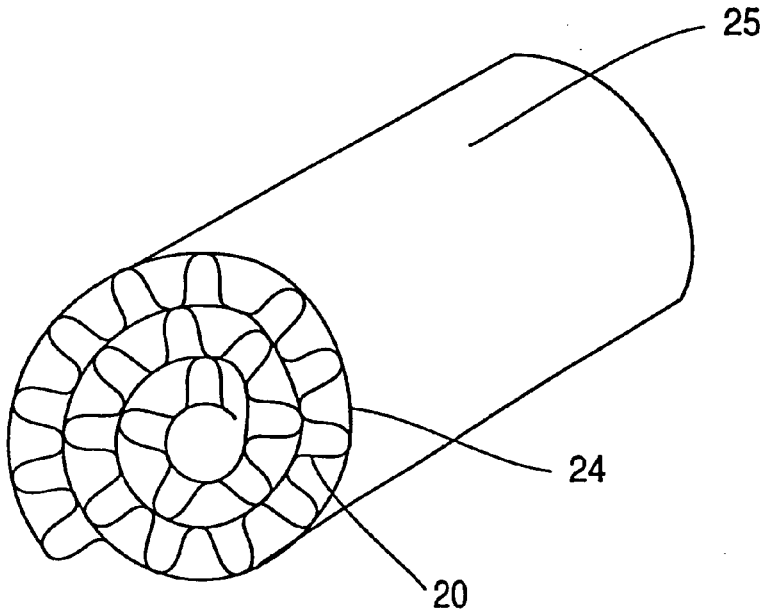

The catalyst structure can be made according to any of the well-known designs, particularly monolithic catalyst structures comprising a multiplicity of parallel longitudinal channels or passageways at least partially coated with catalyst. Typical catalyst structures are disclosed in a variety of published references including U.S. Pat. Nos. 5,183,401; 5,232,257; 5,248,251; 5,250,489 and 5,259,754 to Dalla Betta et al, as well as U.S. Pat. No. 4,870,824 to Young et al. The catalyst structure may be fabricated from a metallic or ceramic substrate in the form of honeycombs, spiral rolls of corrugated sheet, columnar (or "handful of straws") or other configurations having longitudinal channels or passageways permitting high gas space velocities with minimal pressure drops across the catalyst structure. For example, a spiral catalyst structure such as that illustrated in FIG. 2A and 2B may suitably be used. This structure is fabricated by crimping a sheet of metal foil (20) into a corrugated or wavy pattern with depressions (21) and ridges (22) and then rolling it together with a flat metal sheet (24) to form a large spiral (25) of alternate layers of corrugated sheet (20) and flat sheet (24) as a cylindrical unit. To prepare the catalytic structure, the corrugated and/or flat sheets are typically coated on one or both sides with a platinum group metal, preferably palladium and/or platinum, prior to being rolled together to form the spiral catalyst structure. While the illustrated catalyst structure involves a metal foil corrugated in a straight channel structure combined with a flat foil, other suitable spiral catalyst structures include those obtained when two or more corrugated foils having straight or herringbone corrugation patterns are wound together in non-nesting fashion. The catalyst structure supports of the invention are particularly useful in the case of metal spiral catalyst structures since they have a tendency to telescope or deform in the direction of gas flow when exposed to high gas flow rates at temperatures which are sufficiently high, e.g., 1,000° C. or more, to soften or otherwise weaken the metal structure.

The Support Structure

The support structure of the invention is comprised of a monolithic open celled or honeycomb-like structure formed by thin strips or ribs of high temperature resistant metal or ceramic which abuts against one end of the catalyst structure, and extends in a direction perpendicular to the longitudinal axis of the catalyst structure to essentially cover an end face (at either the inlet end or outlet end or both) of the catalyst structure with the support structure being secured on its periphery to the reactor wall. The strips or ribs making up the support structure are bonded together to form a unitary structure having cellular openings at least as large as the catalyst structure channel openings. The cellular openings in the support structure are also positioned to be in fluid communication with the channels of the catalyst structure thus affording essentially unaltered gas flow from the catalyst structure through the support structure.

While the open-celled nature of the support structure of the invention would not be expected to lead to high strength, particularly in high temperature environments, the support structure of the invention surprisingly shows a high level of structural integrity and strength in resisting the axial force placed to it by the catalyst structure's tendency to move or deform in the direction of gas flow through the catalyst structure. As pointed out previously for larger diameter combustion catalysts, i.e., catalysts having diameters of 10 to 25 inches, a typical pressure drop through the catalyst of 4 psi can result in an axial load or force in the direction of gas flow of about 600 to about 1,600 lbs. At axial forces in the above range and at temperatures of about 1,000° C. or more, the support structures of the invention show only very minimal flexing or bowing and any localized deformation of the catalyst structure is essentially eliminated due to the uniform nature of the support provided by the multiple strips or ribs making up the open-celled support monolith. Thus, the support structures of the invention have the dual advantage of being able to support a rather large axial load while still having a very open structure with very low resistance to gas flow through the structure.

The monolithic open cellular support structure of the invention can be either ceramic or metallic as well as any other structural material which is designed to provide significant structural integrity and strength under high temperatures and high loads. High temperature resistant metallic materials which can be usefully employed in the support structures of the invention include high temperature resistant steel alloys such as nickel, cobalt or chromium alloys or other alloys rated for the required temperature service as well as inter-metallic materials and metal-ceramic composites. Of course, different materials can be employed depending on the location of the support structure and the temperature and axial force to which it will be subjected. For example, a support structure employed at the inlet end of the catalyst structure (or in the early stages of a multistage catalyst system) will not be subject to the same temperatures and forces that are applied to the outlet end of the final catalyst stage and therefore the materials of construction can be 5 different. Preferred metallic materials of construction include FeCrAl alloys which typically contain about 20% Cr and about 5% Al with the balance being Fe such as Alfa IV available from Allegheny Ludlum (Pittsburgh, Pa.), Riverlite R20-5SR from Kawasaki Steel (Kobe, Japan) and Aluchrom Y from VDM (Werdohl, Germany). Other preferred metal alloys are the NiCrAl alloys, nickel based super alloys containing about 20% Cr and about 5% Al with the balance being Ni, such as Haynes 214 from Haynes International (Kokomo, Ind.). Suitable ceramic materials include Celcor cordierite from Corning Glass Works (Corning, N.Y.) and Cordierite monolithic substrates available from NGK Locke, Inc. (Southfield, Mich.).

Figure 3A:
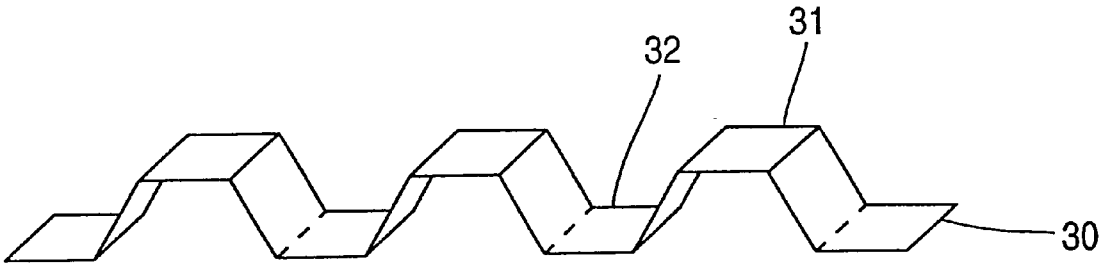
FIGS. 3A and 3B show component parts and a partial cross-section of the inventive support structure.
Figure 3B:
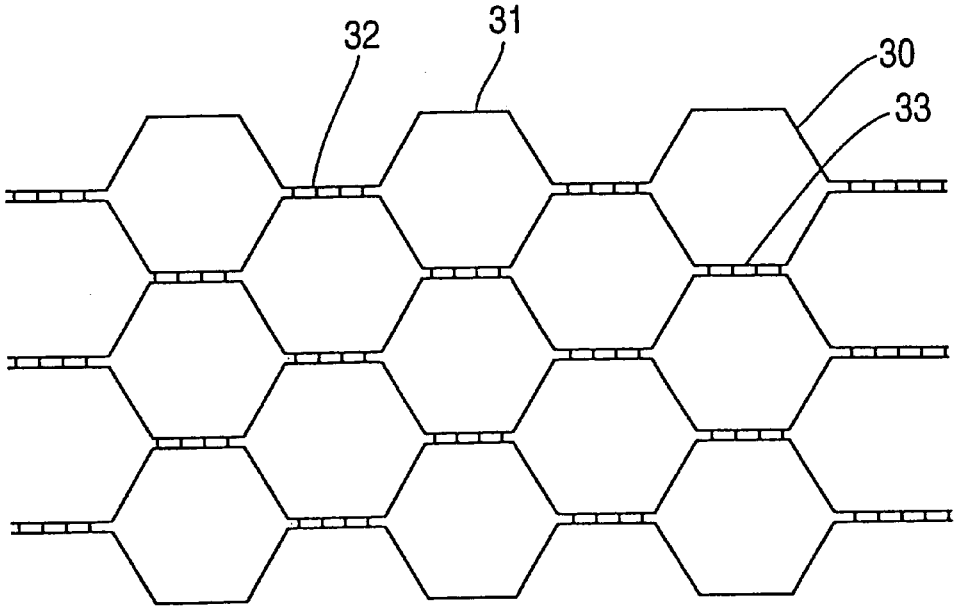

The support structure of the invention can be constructed or fabricated using any conventional technique for forming monolithic honeycomb-like structures, made up of strips or ribs of ceramic or metallic material which are bonded together to form a unitary structure. For example, the structure can be cast as a single unit in the appropriate mold or the structure can be formed by bonding together a series of strips or ribs which have been previously molded or bent to afford the desired cellular opening configuration when they are bonded together. In this regard, FIGS. 3A and 3B illustrate the fabrication of a portion of a support structure according to the invention wherein the structure is a metal monolith having hexagon-shaped cellular openings. This support structure is made up of thin metal strips (30) which have been formed into corrugated strips having flat surfaced ridges (31) and valleys (32). These corrugated strips are laid together to form the hexagonal or honeycomb structure shown in FIG. 3B where the contacting flat portions of the strips are joined together by welding or brazing (33) to form a unitary or 30 monolithic structure. When formed into a complete support structure, the illustrated honeycomb-like structure can be surrounded on its periphery with a circular strip of the metal (not shown) which is bonded to the peripheral portions of the honeycomb in the same fashion as the corrugated strips making up the honeycomb are bonded together. A circular strip of metal or metal frame is employed to give the support structure a circular cross-section which is essentially co-extensive with the cross section of the cylindrical catalyst structure in a direction perpendicular to the gas flow through the catalyst structure. In cases where metal strips make up the support structure, it is preferable to use a brazing technique to bond the strips to one another since this appears to give a stronger, more unitary structure than welding does, however the use of welding as a method of bonding the strips together is not precluded. Welding and brazing may also be used in combination as the method of bonding the strips together.

Figure 4A:
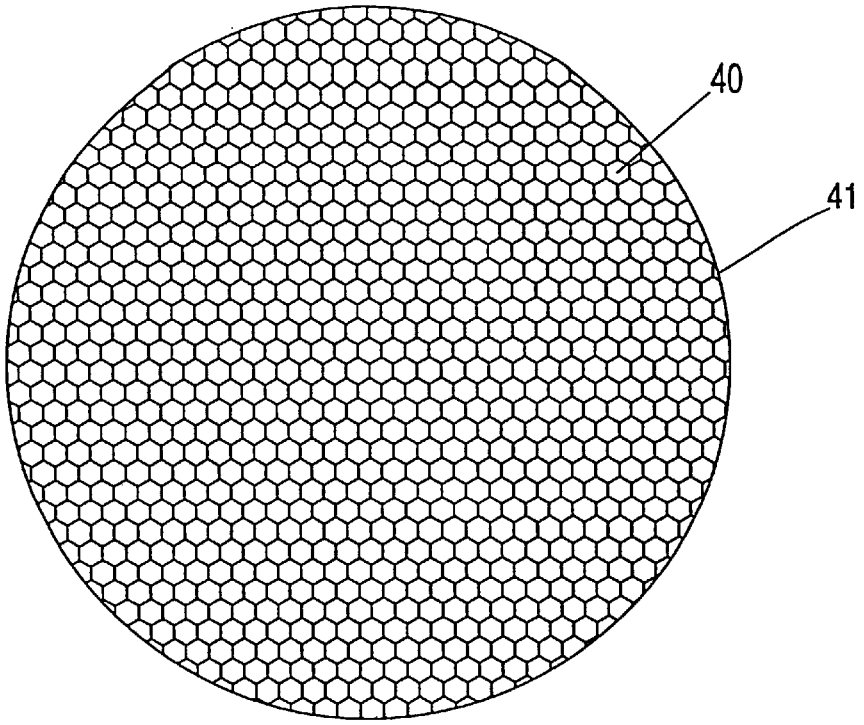
FIGS. 4A through 4E depict end views of various configurations of the inventive catalyst support structure.
Figure 4B:
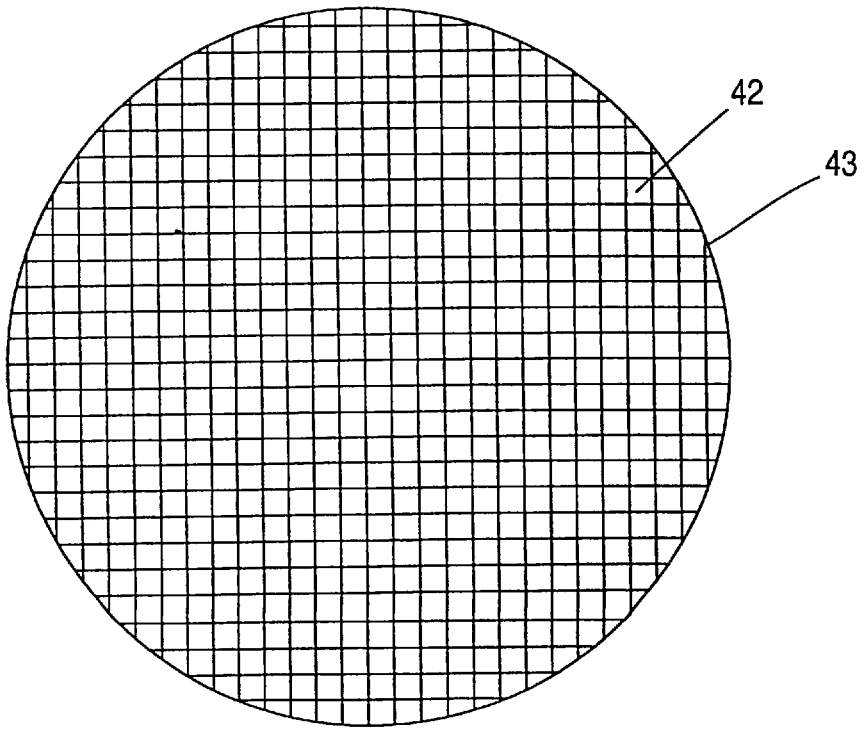
Figure 4C:
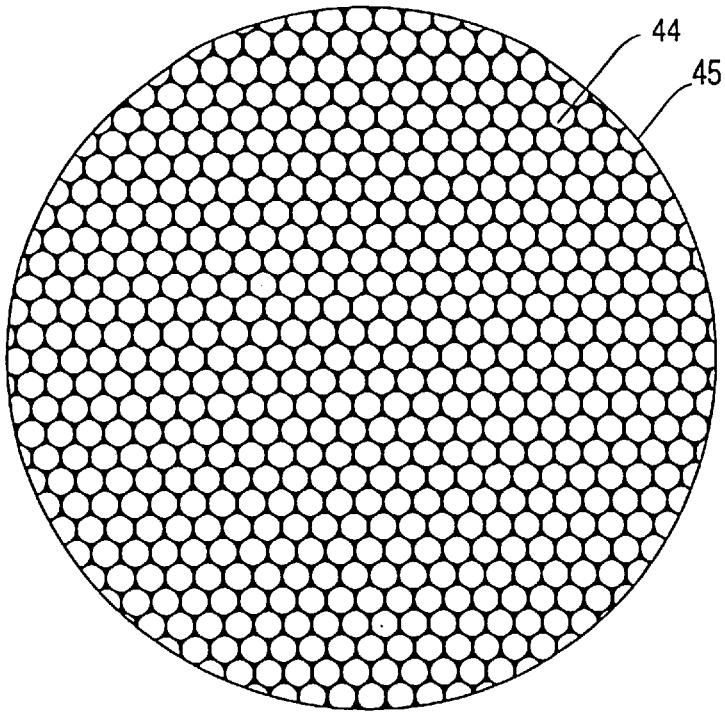
Figure 4D:
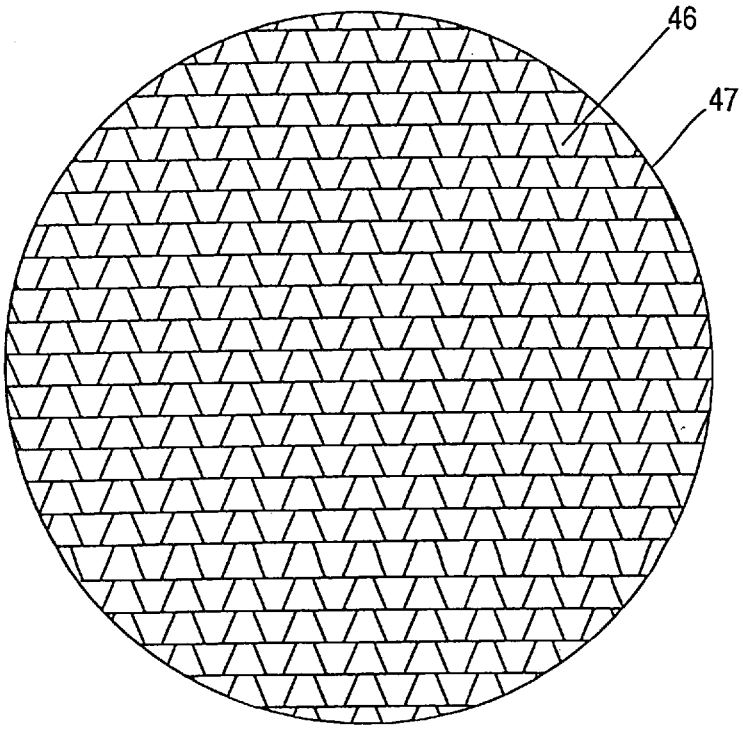
Figure 4E:
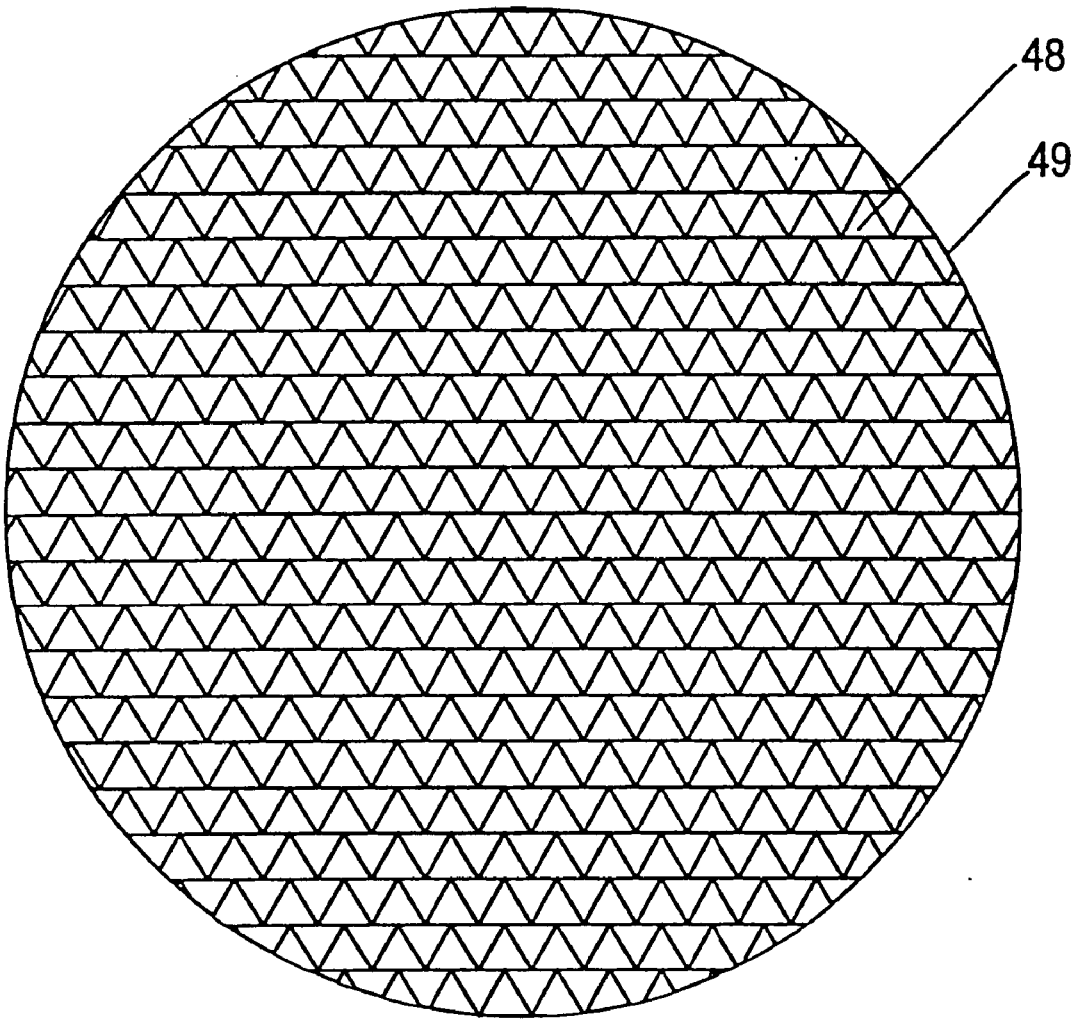

The cellular openings in the support structure of the invention may have a variety of shapes provided they are reasonably uniform in cross-sectional area and allow for sufficient contact between adjacent strips or ribs defining the edges of the cellular openings that a strong bond between the strips or ribs can be created. Suitably, the cells of the open cellular structure can be polygonal, elliptical or circular in shape, with polygonal cells in the shape of trapezoids, triangles, rectangles, squares or hexagons being preferred. Most preferably, the cellular openings are of a hexagon shape from a standpoint of ease of manufacture and the strength of bonds which can be created between adjacent strips or ribs. In this regard, FIGS. 4A through 4E illustrate end views of several different open cell configurations which may be usefully employed in the support structure of the invention for a cylindrical catalyst structure like that shown in FIG. 2B. FIG. 4A shows the cross-section of a support structure having hexagonal cellular openings (40) surrounded by and bonded to the circular strip (41) which frames the support structure while FIG. 4B shows a similar cross-section for a support structure having square cellular openings (42) surrounded by a circular frame (43). FIG. 4C illustrates the cross-section of a support structure according to the invention in which the cellular openings (44) are circular in shape again in a circular frame (45). Finally, FIGS. 4D and 4E show support structures of the invention having trapezoidal cellular openings (46) or triangular cellular openings (48) surrounded in each case by a circular frame (47) and (49).

As pointed out above, it is critical that the cellular openings in the support structure of the invention, regardless of their specific shape, be sized such that they are at least as large in cross-sectional area as the crosssectional area of the individual longitudinal channels making up the catalyst structure. Preferably, the cellular openings are from 1.1 to 200 times as large as the catalyst structure openings which are in fluid communication with the cellular openings to minimize pressure drop or other flow disruption problems. With the typical monolithic catalyst structure employed in catalytic combustion processes, the open cells or cellular openings of the support structure of the invention will have an average cell size or cross-sectional area of from about 0.03 $in^2$ to about 2.0 $in^2$ with average cell sizes in the range of about 0.05 $in^2$ to about 0.2 $in^2$ being most preferred.

The thickness of the strips or ribs making up the support structure of the invention (defined as the cross-sectional dimension of any individual strip measured in a direction perpendicular to the gas flow) and the width of the strips or ribs making up the inventive support structure (defined as the dimension of the strip measured longitudinally in the direction of gas flow) will be determined by a variety of factors relating to the size of the reaction chamber and catalyst structure and the process parameters under which the support structure will be used. For example, the metal or ceramic strip thickness will depend on the flow blockage (pressure drop) which can be tolerated, the axial load to be supported, the diameter of the catalyst structure, the cell size of the open cellular structure and the anticipated temperatures which will be encounted in use. Similarly, the width of the support structure according to the invention will be dependent on factors such as the axial load to be supported, the size of the catalyst structure, the anticipated temperature which will be encountered and the space allowed in the reaction chamber for the support structure. To avoid undue pressure drops and to compensate for other process variables typically encounted, the strips or ribs making up the support structure should be from about 0.5 to about 20 times as thick as the walls of the longitudinally disposed channels of the catalyst structure. For metallic structures the strip thickness is preferably between about 1 to about 10 times as thick as the catalyst channel walls and for ceramic structures the strip or rib thickness is between about 2 to about 20 times as thick as the channel walls of the catalyst structure. In the case of catalyst structures which are typically used in catalytic combustion, the strip thickness of metal support structures of the invention suitably range between about 0.0001 in. to about 0.10 in. with metal strip thickness of between about 0.002 in. and 0.03 in. being preferred and from about 0.005 in. to about 0.02 in. being most preferred. For axial loads typically encountered in catalytic combustion, it is desirable to use a metal strip width in the support structure of the invention of between about 0.25 in. to about 3 in., whereas if a ceramic support structure is employed the strip or rib width is suitably between about 0.75 in. and about 4 in. In each case, however, the specific width and thickness selected will depend to some degree on the local stresses and the actual yield and creep strength of the material of construction selected.

The thickness of the strips or ribs which make up the support structure of the invention coupled with the cell density or cellular opening size in the structure have a direct effect on the extent to which the gas flow to or from the catalyst structure is blocked by the support structure. Suitably, these factors are controlled so that the flow blockage provided by any single support structure according to the invention is less than about 25 percent. Preferably, the flow blockage is between about 5 and 15 percent so as to not unduly disrupt the gas flow properties of the gaseous reaction mixture. In addition, the flow passages in the support structure are preferably straight channels with relatively smooth walls to minimize turbulence in the gas flow and to obtain the lowest resistance to gas flow.

Figure 5:
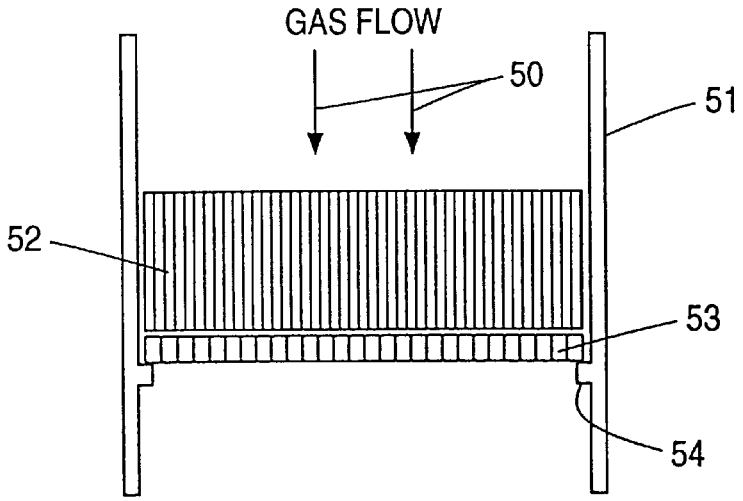
FIGS. 5, 6, 7 and 8 are schematic representations of catalytic reactors according to the invention.
Figure 6:
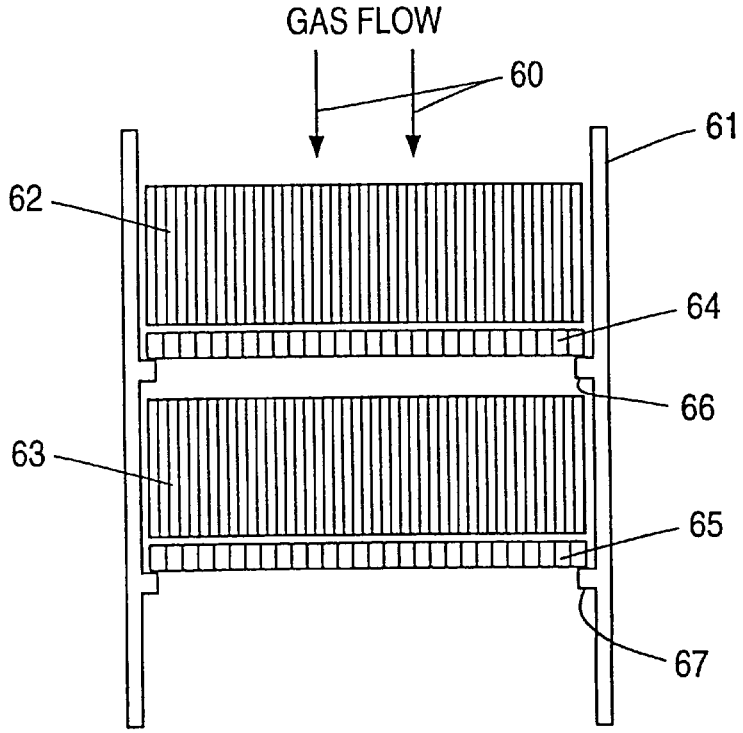
Figure 7:
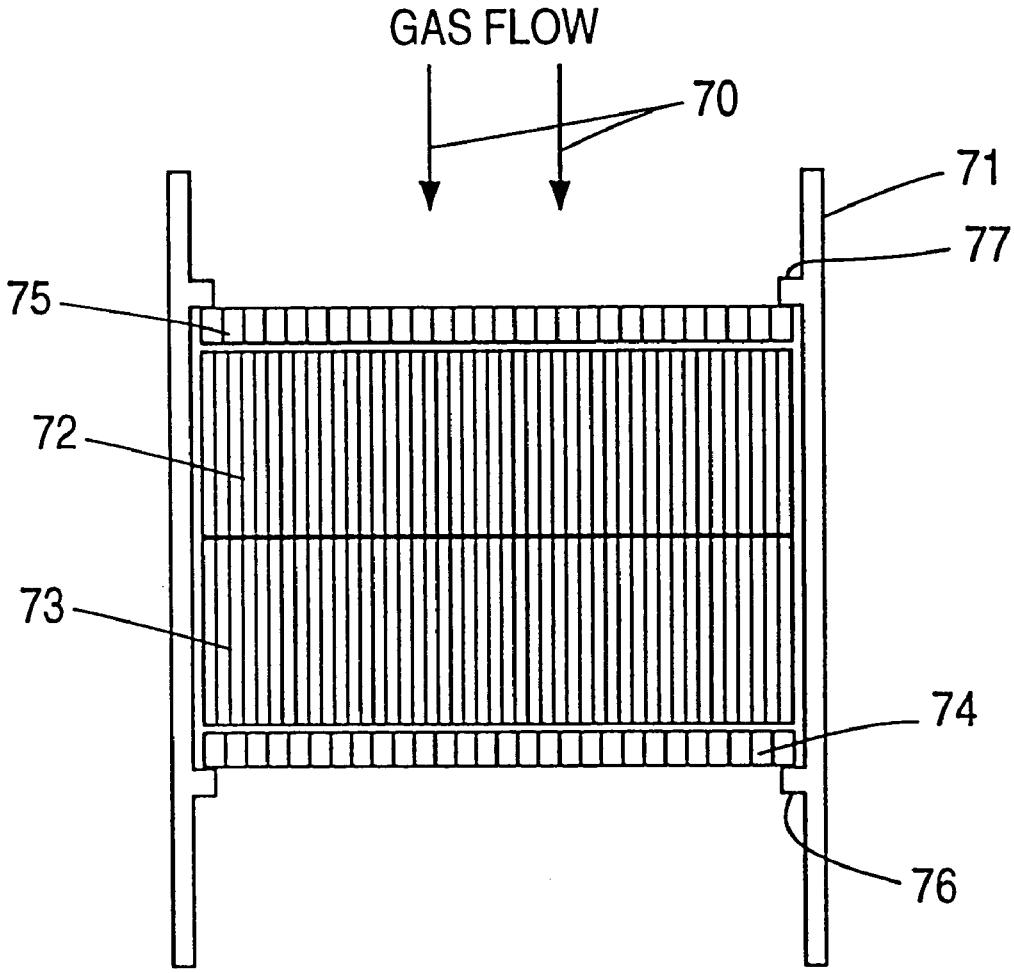

Typical applications of the support structure of the invention in catalytic reactors are shown in FIGS. 5, 6 and 7. In FIG. 5 which depicts a single stage catalytic reactor, such as that utilized in catalytic combustion systems, the gaseous reaction mixture (50) is passed into the catalytic reactor having a reaction chamber defined by the reactor wall (51), which in the case of a catalytic combustor would be the combustor liner wall, and containing a catalyst structure (52) comprising a multiplicity of parallel longitudinal channels for passage of the gaseous reaction mixture. The catalyst structure is secured within the reaction chamber by means of the monolithic open cellular support structure of the invention (53) which is secured to the reactor wall by means of a lip or ridge (54) that is attached to or part of the reactor wall and protrudes in an inward direction forming a ledge on which the outside or peripheral edge of the support structure sets or rests. In this manner, any axial load placed on the support structure by gas flow through the catalyst structure is transferred from the support structure to the reactor wall.

FIG. 6 illustrates a similar reaction system except a two-stage catalytic reactor is employed. In this case, the gaseous reaction mixture (60) again flows into a catalytic reactor having a reaction chamber defined by the reactor wall (61) but in this case there are two monolithic catalyst structures (62) and (63) comprising a first and second stage catalytic reaction system and in each case the catalyst structure is secured in the reaction chamber by means of a support structure of the invention (64) and (65) positioned to abut against the outlet end or face of each of the two catalyst structures. The two support structures shown are secured to the reactor wall by means of inwardly protruding lips or ridges (66) and (67) such that the axial load on the catalyst structures is transferred to the support structure and the support structure then transfers the load to the reactor wall.

Finally, FIG. 7 shows a two stage catalytic reactor with no interstage support but which is secured at its inlet side and on its outlet side with the support structure of the invention. Here again, the gaseous reaction mixture (70) is passed into a catalytic reactor having a reaction chamber defined by the reactor wall (71) and containing a multistage catalyst comprising two catalytic monoliths (72) and (73) which abut against each other, each having a multiplicity of parallel longitudinal channels which are in fluid communication with channels in the other catalyst stage. The two stage catalyst structure is secured within the reaction chamber by means of the support structure of the invention which is placed at both the outlet end (74) of the second stage of the catalyst structure and the inlet end (75) of the first stage of the catalyst structure to essentially sandwich the catalyst structure within the reaction chamber and secure it from axial movement in either direction. Both the support structure at the outlet end and the support structure at the inlet end of the two stage system are secured by a lip or ridge (76) and (77) which extends inwardly from the reactor wall thus serving to transfer any axial force to the reactor wall.

The utilization of an inwardly protruding lip or ridge on the reactor wall on which the support structure of the invention rests or sits has clear operating advantages over, for example, actually welding or otherwise fixing and immobilizing the periphery of the support to the reactor wall. This is because the ridge or lip can accommodate support structures which do not extend all the way to the reactor wall thus affording a free space to accommodate the thermal expansion of the support which can occur on contact with the hot gas flow. Preferably, the support structure of the invention is sized and a ridge or lip is used such that the support can expand by up to 2% of its diameter in a peripheral direction without pressing against or contacting the reactor wall. In a preferred embodiment, the lip or ridge on the reactor wall on which the downstream or outlet side of the support structure rests or sets as shown in FIGS. 5, 6 and 7 can be duplicated in a position immediately before the inlet side or surface of the support structure to, in effect, form a slot in which the support structure can fit but still have the freedom to undergo thermal expansion. With this preferred means of securing the support structure to the reaction wall, any sudden back pressure on the support structure will not cause a dislocation of the support structure.

Figure 8:
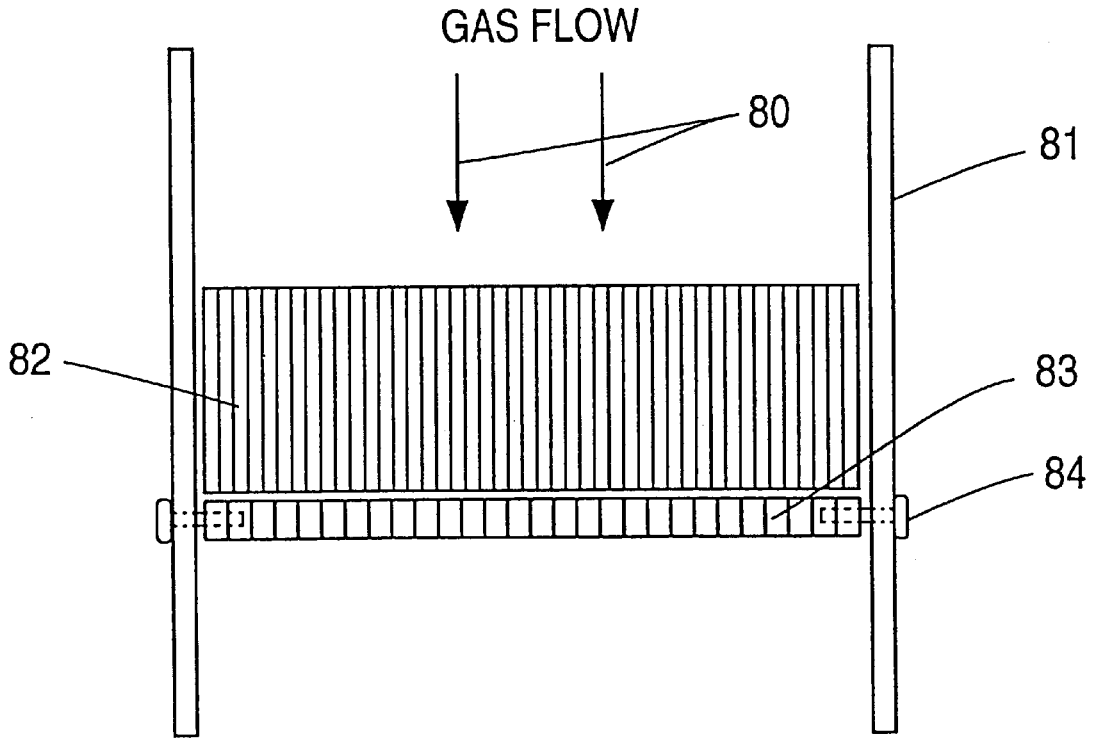

An alternate but preferred method of securing the support structure of the invention to the reactor wall is shown in FIG. 8 which illustrates a single stage catalytic reactor in which the gaseous reaction mixture (80) is passed into a catalytic reactor having a reaction chamber defined by the reactor wall (81) and containing a catalyst structure (82) held securely in the reactor by means of the open cellular support structure of the invention (83). In this preferred embodiment of the invention, the support structure, which does not extend all the way to the reactor wall is, attached to the reactor wall by means of rivets (84) which extend through the reactor wall into a series of cavities in the support structure which are sufficient in depth to allow for thermal expansion of the support structure on exposure to the hot reaction gas. That is, the rivet penetrates into the support structure for a sufficient length to hold the support structure securely while leaving an adequate open area at the end of the rivet to allow for differential thermal expansion of the support structure.

Figure 9A:
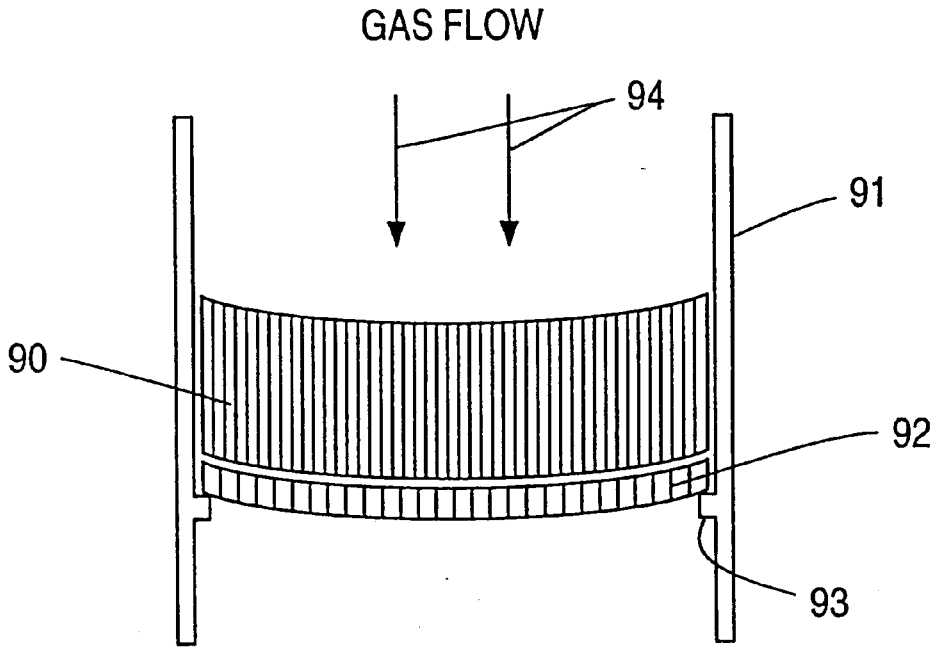
FIGS. 9A and 9B show schematically the effects of axial load due to high gas flow through the catalyst structure on the inventive support structure.
Figure 9B:
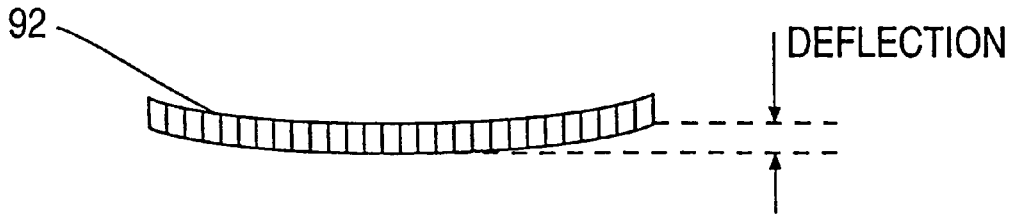

As pointed out above, one of the important and surprising advantages of the support structure of the invention is the superior strength which it exhibits when subject to high axial loads or forces as a result of high gas flows through the monolithic catalyst structure which it supports. That is, when a high axial load is placed on the support structure, the support structure will show a tendency to flex or bow in the same direction as the axial force is being exerted and in the case of the support structure of the invention, a surprising resilience to such bowing or deformation is observed even when the structure is subject to high thermal stress in addition to high axial loads. For the support structures of the invention this is illustrated by FIGS. 9A and 9B showing a catalytic reactor where the catalyst structure (90) is secured within the reaction chamber wall (91) by means of the support structure of the invention (92) at the outlet side of the catalyst structure, which support structure, in turn, is secured to the reactor wall by means of a lip or ridge (93) protruding inwardly into the reaction chamber. In this case, the gas flow (94) through the catalyst structure is such that the axial force exerted on the support structure causes a deflection or bending of the support structure (shown in exaggerated form in FIG. 9B) in the direction of gas flow. For purposes of this invention this deflection can be expressed and quantified as the deformation index for any given support structure where the "deformation index" is defined as the ratio (numeric) of the deflection or bowing in the support structure which occurs at a standard or typical load from axial gas flow on the catalyst, that is, 4 psi, which is typical for catalytic combustion applications, divided by the length of the diameter (or approximate diameter for non-circular supports) of the support structure. The deflection or bowing is measured as shown in FIG. 9B as the difference between the bow in the support in an unstressed condition versus the bow which occurs under the standard axial load, i.e., 4 psi. For the support structures of the invention this deformation index is suitably between about 0.00001 and about 0.05 and preferably in the range of about 0.001 to about 0.02. These exceedingly low deformation indexes, which hold even for support structures of the invention exposed to temperatures in the range of about 1,000° C., demonstrate the superior strength of the support structures according to the invention when subject to the high axial loads characteristic of processes such as catalytic combustion, which operate at very high gas flow rates.

The Process

The support structure of the invention, as described above, can be used in a process for the catalytic combustion of a hydrocarbonaceous or other combustible fuel, e.g., methane, ethane, $H_2$ or $CO/H_2$ mixtures. In this process, an oxygen-containing gas, such as air, is mixed with the hydrocarbonaceous fuel to form a combustible oxygen/fuel mixture. This oxygen/fuel mixture is passed as a flowing gas through a monolithic catalyst structure that is positioned within a reaction chamber to combust the oxygen/fuel mixture and form a hot, partially or completely combusted, gas product.

A variety of catalyst structures can be used in this process. For example, a catalyst structure having integral heat exchange surfaces as described in U.S. Pat. No. 5,250,489, entitled "Catalyst Structure Having Integral Heat Exchange," or a graded palladium-containing partial combustion process catalyst as described in U.S. Pat. Nos. 5,248,251 and 5,258,349 both entitled "Graded Palladium-Containing Partial Combustion Catalyst and Process for Using It," may be used in this invention. In addition, the process may involve complete combustion of the fuel or partial combustion of the fuel as described in the co-pending application, U.S. Ser. No. 08/088,614, entitled "Process for Burning Combustible Mixtures." Furthermore, the process may be a multistage process in which the fuel is combusted stepwise using specific catalysts and catalyst structures in the various stages, as described in U.S. Pat. No. 5,232,357, entitled "Multistage Process for Combusting Fuel Mixtures Using Oxide Catalysts in the Hot Stage." The above six patents and one patent application are herein incorporated by reference.

This process also involves stabilizing the position of the catalyst structure in the reaction chamber so as to prevent the axial movement of the catalyst structure. The catalyst structure is stabilized in the reaction chamber by means of a monolithic open cellular structure in which the walls of the cells are formed by strips of a high temperature resistant metal or ceramic material to afford cellular openings which are at least as large as the openings formed by the catalyst structure channels at their inlet and outlet ends, said monolithic open cellular structure being:

(a) placed at the outlet end of catalyst structure, or at the inlet end of the catalyst structure or at both the inlet end and the outlet end of the catalyst structure;

(b) positioned and configured to abut against one end of the catalyst structure and extend in a direction perpendicular to the longitudinal axis of the catalyst structure to essentially cover the end face of the catalyst structure, with the cellular openings of the monolithic open cellular structure being in fluid communication with the channels of the catalyst structure; and (c) secured on its periphery to the reaction chamber wall thereby limiting the axial movement of said catalyst structure parallel to the longitudinal axis of said catalyst structure.

It should be clear that one having ordinary skill in the art could envision equivalents to the devices found in the claims that follow and that these equivalents would be within the scope and spirit of the claimed invention.

We claim as our invention:

1. A support structure for securing within a combustion reaction chamber, defined by a reaction chamber wall, a monolithic catalyst structure made up of a multiplicity of longitudinally disposed channels with inlet and outlet ends for passage of a flowing gas mixture, which exerts an axial load on the catalyst structure in the direction of gas flow, with the catalyst structure having a longitudinal axis in the direction of gas mixture flow, said support structure comprising a monolithic open cellular structure wherein the walls of the cells are formed by strips of a high temperature resistant metal or ceramic material to afford cellular openings which are at least as large as the openings formed by the catalyst structure channels at their inlet and outlet ends, said monolithic open cellular structure being:

(a) placed at the outlet end of catalyst structure, or at both the inlet end and the outlet end of the catalyst structure;

(b) positioned and configured to abut against one end of the catalyst structure and extend in a direction perpendicular to the longitudinal axis of the catalyst structure to essentially cover the end face of the catalyst structure, with the cellular openings of the monolithic open cellular structure being in fluid communication with the channels of the catalyst structure; and (c) secured on an outer periphery to the reaction chamber wall by an attachment means fixed to the reaction chamber wall which holds the monolithic open cellular structure in place while allowing for differential thermal expansion of the monolithic open cellular structure in an outward direction towards the reaction chamber wall such that the axial load which is placed on the monolithic open cellular structure by the catalyst structure on passage of the flowing gas mixture is transferred to the reaction chamber wall thereby limiting axial movement of said catalyst structure in a direction parallel to the longitudinal axis of said catalyst structure.

2. The support structure of claim 1 wherein the monolithic open cellular structure is placed at the outlet end of the catalyst structure.

3. The support structure of claim 1 wherein the monolithic open cellular structure is placed at both the inlet end and the outlet end of the catalyst structure.

4. The support structure of claim 1, 2 or 3 wherein the cells of the open cellular structure are polygonal, elliptical or circular in shape.

5. The support structure of claim 4 wherein the cells are polygonal in shape.

6. The support structure of claim 5 wherein the polygonal cells are in the shape of trapezoids, triangles, rectangles, squares, or hexagons.

7. The support structure of claim 1 wherein the flow blockage relative to unobstructed gas flow provided by any single monolithic open cellular structure at the inlet or outlet end of the catalyst structure is less than about 25 percent.

8. The support structure of claim 7 wherein the flow blockage is between about 5 and 15 percent.

9. The support structure of claim 1 wherein the metal or ceramic strips making up the monolithic open cellular structure are from about 0.5 to 20 times as thick as the walls of the longitudinally disposed channels of the catalyst structure.

10. The support structure of claim 9 wherein the catalyst structure channel walls and the strips making up the monolithic open cellular structure are both comprised of a high temperature resistant metal material.

11. The support structure of claim 9 wherein the width of the strips making up the monolithic open cellular structure is between about 0.25 and 4 inches.

12. The support structure of claim 1, 2, 3, 10 or 11 wherein the deformation index for the monolithic open cellular structure is between about 0.0001 and 0.05.

13. The support structure of claim 1 wherein the open cells of the monolithic open cellular structure have an average cell size (cross-sectional area) ranging from about 0.03 $in^2$ to 2.0 $in^2$.

14. The support structure of claim 1 wherein the attachment means is selected from (a) an inwardly protruding ledge on the interior side of the reaction chamber wall on which one face side of the periphery of the monolithic open cellular structure rests in a slideable fashion to accommodate differential thermal expansion of the monolithic open cellular structure; or (b) a series of rivets which extend through the reaction chamber wall into cavities on the peripheral surface of the monolithic open cellular structure with the difference in the depth of the cavities and length of the rivets being such that differential thermal expansion of the monolithic open cellular structure can be accommodated.

15. A method for securing within a combustion reaction chamber defined by a reaction chamber wall, a monolithic catalyst structure made up of a multiplicity of longitudinally disposed channels with inlet and outlet ends for passage of a flowing gas mixture and having a longitudinal axis in the direction of gas mixture flow, said flowing gas mixture exerting an axial load on the catalyst structure, which comprises inserting into the reaction chamber at the outlet end of the catalyst structure or at both the outlet end and inlet end of the catalyst structure, a monolithic open cellular structure in which the walls of the cells are formed by strips of a high temperature resistant metal or ceramic material to afford cellular openings which are at least as large as the openings formed by the catalyst structure channels at their inlet and outlet ends, said monolithic open cellular structure being:

(a) positioned and configured to abut against one end of the catalyst structure and extend in a direction parpendicular to the longitudinal axis of the catalyst structure to essentially cover the end face of the catalyst structure, with the cellular openings of the monolithic open cellular structure being in fluid communication with the channels of the catalyst structure; and (b) secured on an outer periphery to the reaction chamber wall by an attachment means fixed to the reaction chamber wall which holds the monolithic open cellular structure in place while allowing differential thermal expansion of the monolithic open cellular structure in an outward direction towards to reaction chamber wall such that the axial load which is placed on the monolithic open cellular structure by the catalyst structure on passage of the flowing gas mixture is transferred to the reaction chamber wall thereby limiting axial movement of said catalyst structure.

16. A process for the combustion of a hydrocarbonaceous or other combustible fuel to form a hot gas product wherein the fuel is at least partially combusted, the process comprising the steps of:

(a) forming a mixture of the fuel with an oxygen-containing gas; and (b) passing the oxygen-containing gas and fuel mixture as a flowing gas stream through a monolithic catalyst structure positioned in a combustion reaction chamber defined by a reaction chamber wall, said catalyst structure made up of a multiplicity of longitudinally disposed channels for passage of said flowing gas stream and having a longitudinal as in the direction of gas mixture flow, said catalyst structure being stablized in said reaction chamber by means of a monolithic open cellular structure in which the walls of the cells are formed by strips of a high temperature resistant metal or ceramic material to afford cellular openings which are at least as large as the openings formed by the catalyst structure channels at their inlet and outlet ends, said monolithic open cellular structure being:

(i) placed at the outlet end of catalyst structure or at both the inlet end and the outlet end of the catalyst structure;

(ii) positioned and configured to abut against one end of the catalyst structure and extend in a direction perpendicular to the longitudinal axis of the catalyst structure to essentially cover the end face of the catalyst structure, with the cellular openings of the monolithic open cellular structure being in fluid communication with the channels of the catalyst structure; and (iii) secured on an outer periphery to the reaction chamber wall by an attachment means fixed to the reaction chamber wall which holds the monolithic open cellular structure in place while allowing for differential thermal expansion of the monolithic open cellular structure in an outward direction towards the reaction chamber wall thereby limiting the axial movement of said catalyst structure parallel to the longitudinal axis of said catalyst structure.

17. The process of claim 16 wherein the monolithic open cellular structure is placed at the outlet end of the catalyst structure.

18. The process of claim 16 wherein the monolithic open cellular structure is placed at both the inlet end and the outlet end of the catalyst structure.

19. The process of claim 16, 17 or 18 wherein the cells of the open cellular structure are polygonal, elliptical or circular in shape.

20. The process of claim 19 wherein the cells are polygonal in shape.

21. The process of claim 20 wherein the polygonal cells are in the shape of trapezoids, triangles, rectangles, squares, or hexagons.

22. The process of claim 16 wherein the flow blockage relative to unobstructed gas flow provided by any single monolithic open cellular structure at the inlet or outlet end of the catalyst structure is less than about 25 percent.

23. The process of claim 22 wherein the flow blockage is between about 5 and 15 percent.

24. The process of claim 16 wherein the metal or ceramic strips making up the monolithic open cellular structure are from about 0.5 to 20 times as thick as the walls of the longitudinally disposed channels of the catalyst structure.

25. The process of claim 24 wherein the catalyst structure channel walls and the strips making up the monolithic open cellular structure are both comprised of a high temperature resistant metal material.

26. The process of claim 24 wherein the width of the strips making up the monolithic open cellular structure is between about 0.25 and 4 inches.

27. The process of claims 16, 17, 18, 25 or 26 wherein the deformation index for the monolithic open cellular structure is between 0.0001 and about 0.05.

28. The process of claim 16 therein the open cells of the monolithic open cellular structure have an average cell size (cross-sectional area) ranging from about 0.03 $in^2$ to 2.0 $in^2$.

29. A support structure for securing within a combustion reaction chamber defined by a reaction chamber wall, a multi-stage monolithic catalyst structure made up of a multiplicity of longitudinally disposed channels with inlet and outlet ends from each stage for passage of a flowing gas mixture which exerts an axial load on the catalyst structure in the direction of gas flow with the catalyst structure having a longitudinal as in the direction of gas mixture flow, said support structure comprising a monolithic open cellular structure wherein the walls of the cells are formed by strips of a high temperature resistant metal or ceramic material to afford cellular openings which are at least a large as the openings formed by the catalyst structure channels at their inlet and outlet, ends, said monolithic open cellular structure being:

(a) placed at the outlet end of each stage of the catalyst structure, or at the inlet end of the first stage of the catalyst structure and the outlet end of one or more of the catalyst stages including the final catalyst stage in the catalyst structure;

(b) positioned and configured to abut against one end of the catalyst structure and extend in a direction perpendicular to the longitudinal axis of the catalyst structure to essentially cover the end face of the catalyst structure, with the cellular openings of the monolithic open cellular structure being in fluid communication with the channels for the catalyst structure; and (c) secured on an outer periphery to the reaction chamber wall by an attachment means fixed to the reaction chamber wall which hold the monolithic open cellular structure in place while allowing for differential thermal expansion of the monolithic open cellular structure in an outward direction towards the reaction chamber wall such that the axial load which is placed on the monolithic open cellular structure by the catalyst structure on passage of the flowing gas mixture is transferred to the reaction chamber wall thereby limiting axial movement of said catalyst structure parallel to the longitudinal axis of said catalyst structure.

* * * * *